US012449222B2

(12) United States Patent
Modlin

(10) Patent No.: US 12,449,222 B2
(45) Date of Patent: Oct. 21, 2025

(54) FIREARM MOUNTING SYSTEM

(71) Applicant: Wesley Modlin, Omaha, NE (US)

(72) Inventor: Wesley Modlin, Omaha, NE (US)

( * ) Notice: Subject to any disclaimer, the term of this patent is extended or adjusted under 35 U.S.C. 154(b) by 0 days.

(21) Appl. No.: 18/752,625

(22) Filed: Jun. 24, 2024

(65) Prior Publication Data

US 2024/0426566 A1 Dec. 26, 2024

Related U.S. Application Data

(60) Provisional application No. 63/522,978, filed on Jun. 23, 2023.

(51) Int. Cl.
*F41A 23/14* (2006.01)

(52) U.S. Cl.
CPC ..... *F41A 23/14* (2013.01)

(58) Field of Classification Search
CPC ..... F41A 23/06; F41A 23/10; F41A 23/14; F41A 23/24; F41A 27/12; F41A 27/22; F41A 27/24; F41A 27/30; F41C 27/22; F41C 33/001
USPC ..... 89/37.04, 37.11, 40.06
See application file for complete search history.

(56) References Cited

U.S. PATENT DOCUMENTS 8,549,786 B1 10/2013 Griffith
8,894,024 B2 11/2014 Deros
9,151,562 B1 10/2015 Pugliese
9,328,992 B1 * 5/2016 Smith ..... F41C 33/001
10,436,537 B2 10/2019 Fudala et al.
10,584,935 B1 3/2020 Afshari
11,391,534 B1 * 7/2022 Azhocar ..... F41A 23/14
11,512,918 B2 11/2022 Johnson, Sr. et al.
2004/0083637 A1 * 5/2004 Sands ..... F41C 33/001 42/85
2007/0151999 A1 * 7/2007 Thompson ..... F41C 33/001 224/150
2016/0195361 A1 * 7/2016 Barnett ..... F41G 11/003 42/90
2018/0224062 A1 * 8/2018 Yokiel ..... F16M 11/24
2022/0120529 A1 * 4/2022 Burnett ..... F41A 23/005
2022/0128326 A1 * 4/2022 Kimmel ..... F41A 23/14

* cited by examiner

*Primary Examiner* — Bret Hayes

(74) *Attorney, Agent, or Firm* — Suiter Swantz IP

(57) ABSTRACT

A firearm mounting system is provided. The system may include a base assembly. The base assembly may include a base body and a tension control sub-system. The system may include a bracket coupled to a top surface of the base body. The system may include a swing arm pivotably coupled to the bracket, where the swing arm further includes a vertical support leg and a horizontal support leg able to pivot about an axis. The system may include a support plate coupled to the horizontal support leg of the swing arm, where the support plate provides elevational control of the firearm mounting system. The system may include at least one support coupling to couple the support plate to at least a portion of a firearm.

20 Claims, 17 Drawing Sheets

FIREARM MOUNTING SYSTEM

CROSS-REFERENCE TO RELATED APPLICATION

The present application claims the benefit under 35 U.S.C. § 119(e) of U.S. Provisional Application Ser. No. 63/522,978, filed Jun. 23, 2023, entitled "FIREARM MOUNTING SYSTEM", naming Wesley Modlin as inventor, which is incorporated herein by reference in the entirety.

TECHNICAL FIELD

The present disclosure relates generally to firearm support systems and, more particularly, to a firearm mounting system incorporating tension control mechanisms and adjustable support features.

BACKGROUND

In general, modern firearms are operable by a user either independently or with support devices such as bipods, tripods, and the like. A user may choose to operate (e.g., aim or shoot) the firearm independently by physically holding the firearm, or a user may choose to utilize a support device to help stabilize the firearm during operation. Typical support devices are known to be used with rifles and other various lightweight firearms for supporting at least a portion of the firearm weight and reducing unwanted movement. Further, utilizing a support device may help the user improve their aim and reduce any fatigue that is normally associated with holding the firearm.

However, many mounting devices used to couple the firearm to the support device include ball and socket type connections which are known to provide a significant amount of variation which may have an undesirable impact on the precision and steadiness of the firearm during its operation. Therefore, there exists a need for a system which cures one or more of the shortfalls of previous approaches identified above.

SUMMARY

A firearm mounting system is disclosed, in accordance with one or more illustrative embodiments of the present disclosure. In one illustrative embodiment, the system includes a base assembly. In another illustrative embodiment, the base assembly includes a base body and a tension control sub-system. In another illustrative embodiment, the system includes a bracket coupled to a top surface of the base body. In another illustrative embodiment, the system includes a swing arm pivotably coupled to the bracket, where the swing arm further includes a vertical support leg and a horizontal support leg able to pivot about an axis. In another illustrative embodiment, the system includes a support plate coupled to the horizontal support leg of the swing arm, where the support plate provides elevational control of the firearm mounting system. In another illustrative embodiment, the system includes at least one support coupling to couple the support plate to at least a portion of a firearm.

BRIEF DESCRIPTION OF THE DRAWINGS

The numerous advantages of the disclosure may be better understood by those skilled in the art by reference to the accompanying figures.

DETAILED DESCRIPTION

Figure 1A:
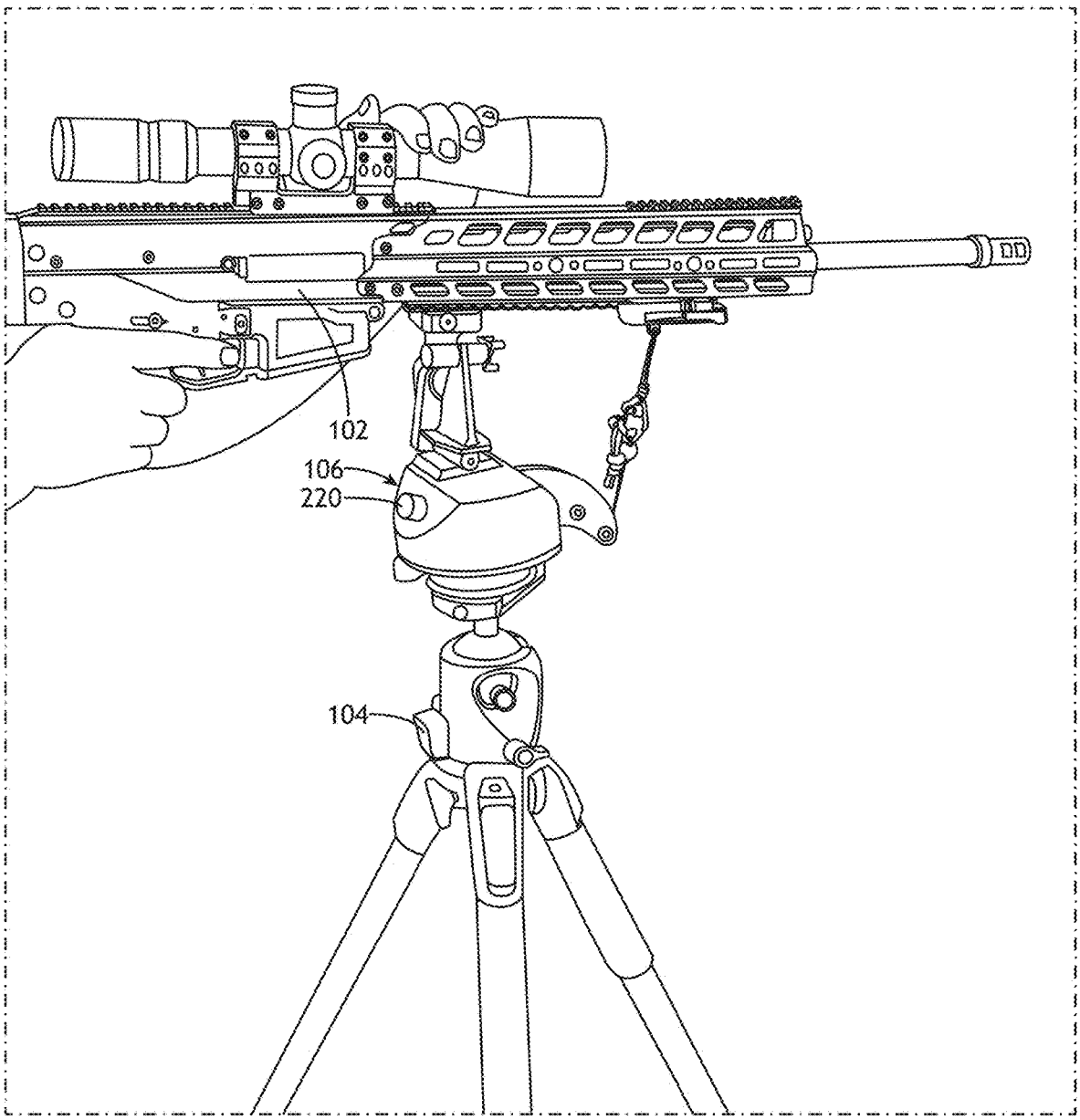
FIGS. 1A-1B illustrate perspective views of the firearm mounting system, in accordance with one or more embodiments of the present disclosure.
Figure 1B:
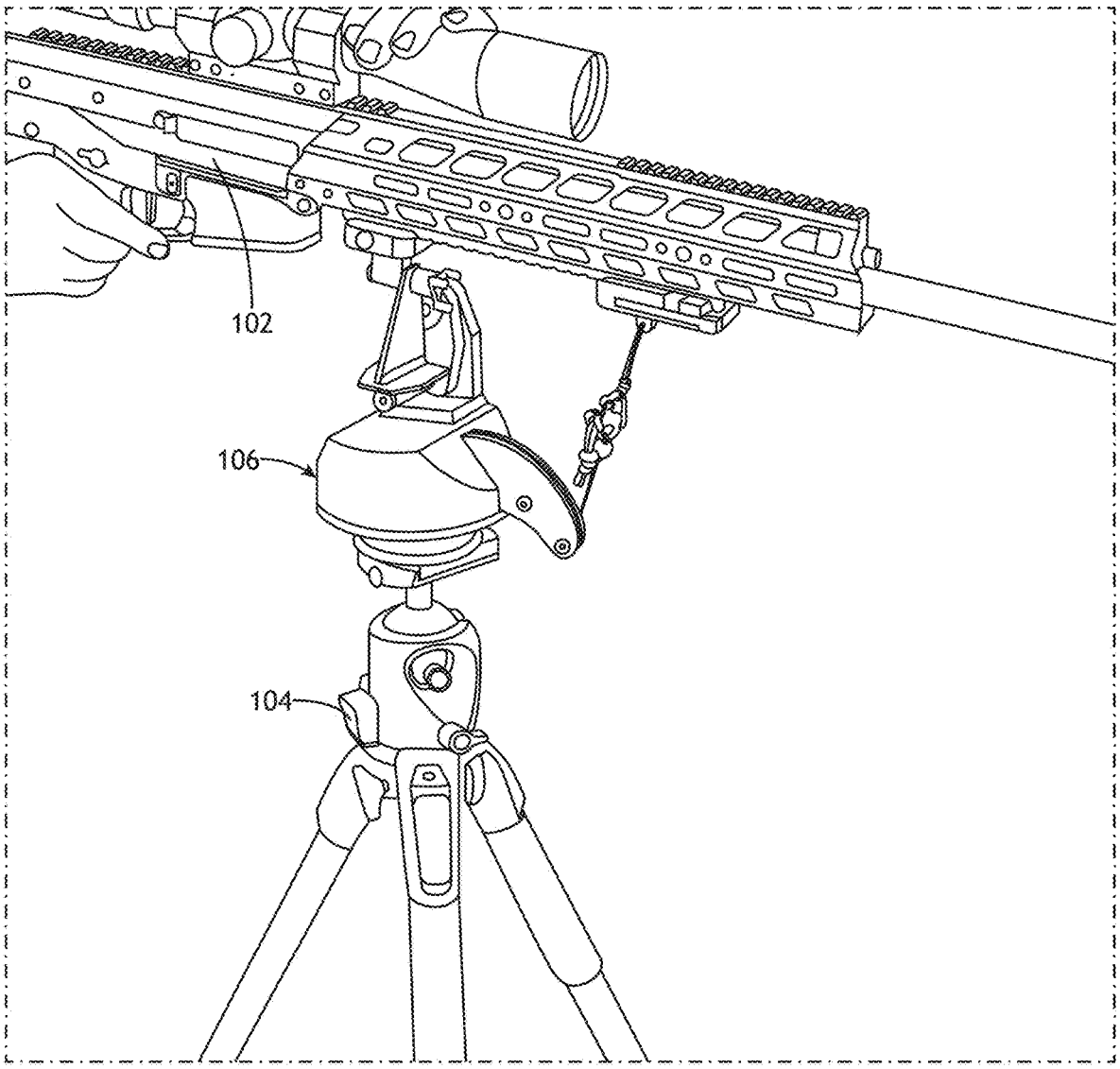

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Reference will now be made in detail to the subject matter disclosed, which is illustrated in the accompanying drawings.

Referring generally to FIGS. 1A-5B, a firearm mounting system 100 is illustrated, in accordance with one or more embodiments of the present disclosure.

In embodiments, the system 100 is configured to securely couple a firearm 102 to a support device 104. For instance, the support device 104 may include, but is not limited to, a monopod, bipod, or tripod.

In embodiments, the firearm mounting system 100 includes a base assembly 106. The base assembly may serve as the primary structure to which other components are attached. For example, the base assembly 106 may include a tension control sub-system 200, which provides controlled resistance to firearm movement.

Figure 2A:
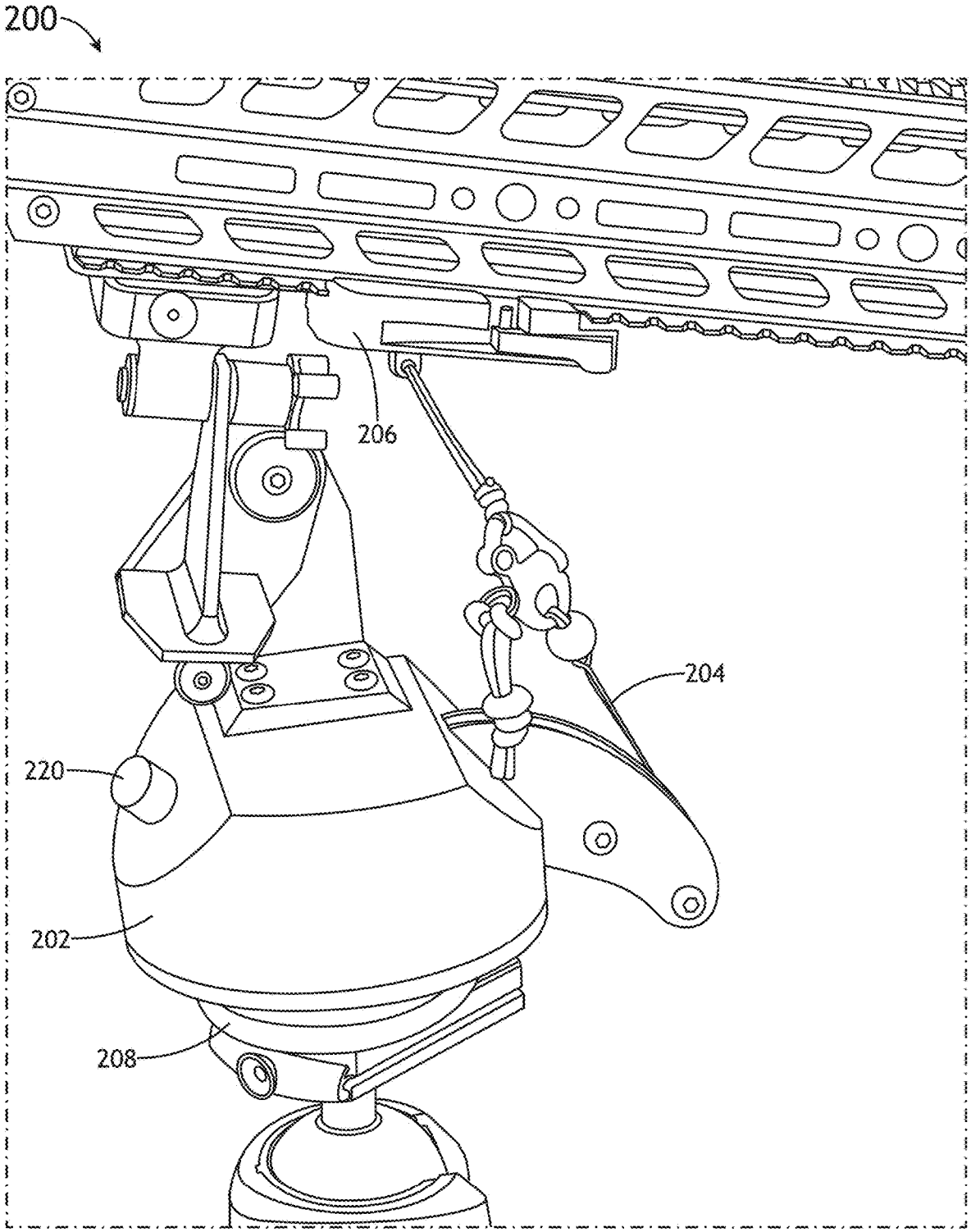
FIGS. 2A-2C illustrate perspective views of the firearm mounting system including a tension control sub-system, in accordance with one or more embodiments of the present disclosure.
Figure 2B:
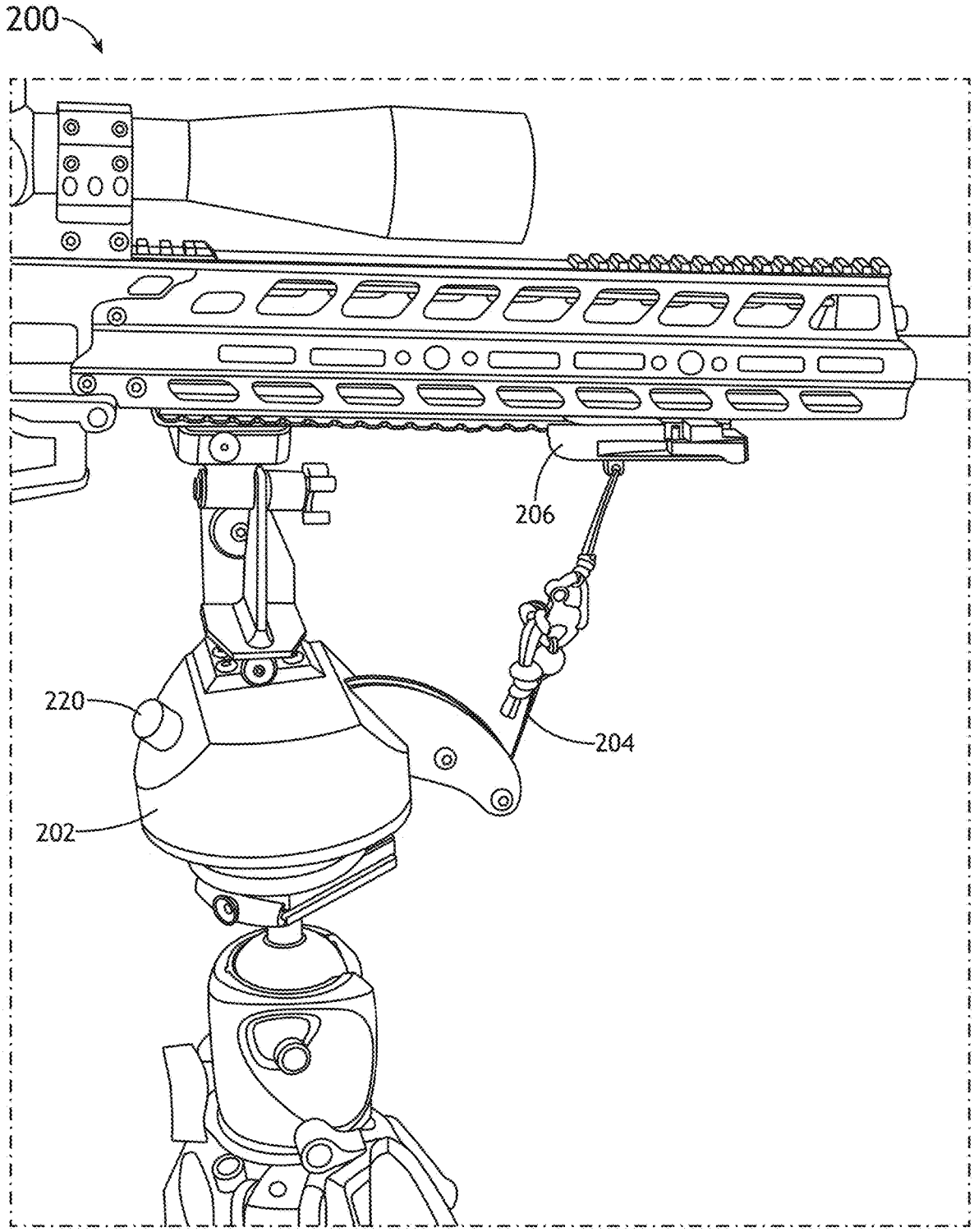
Figure 2C:
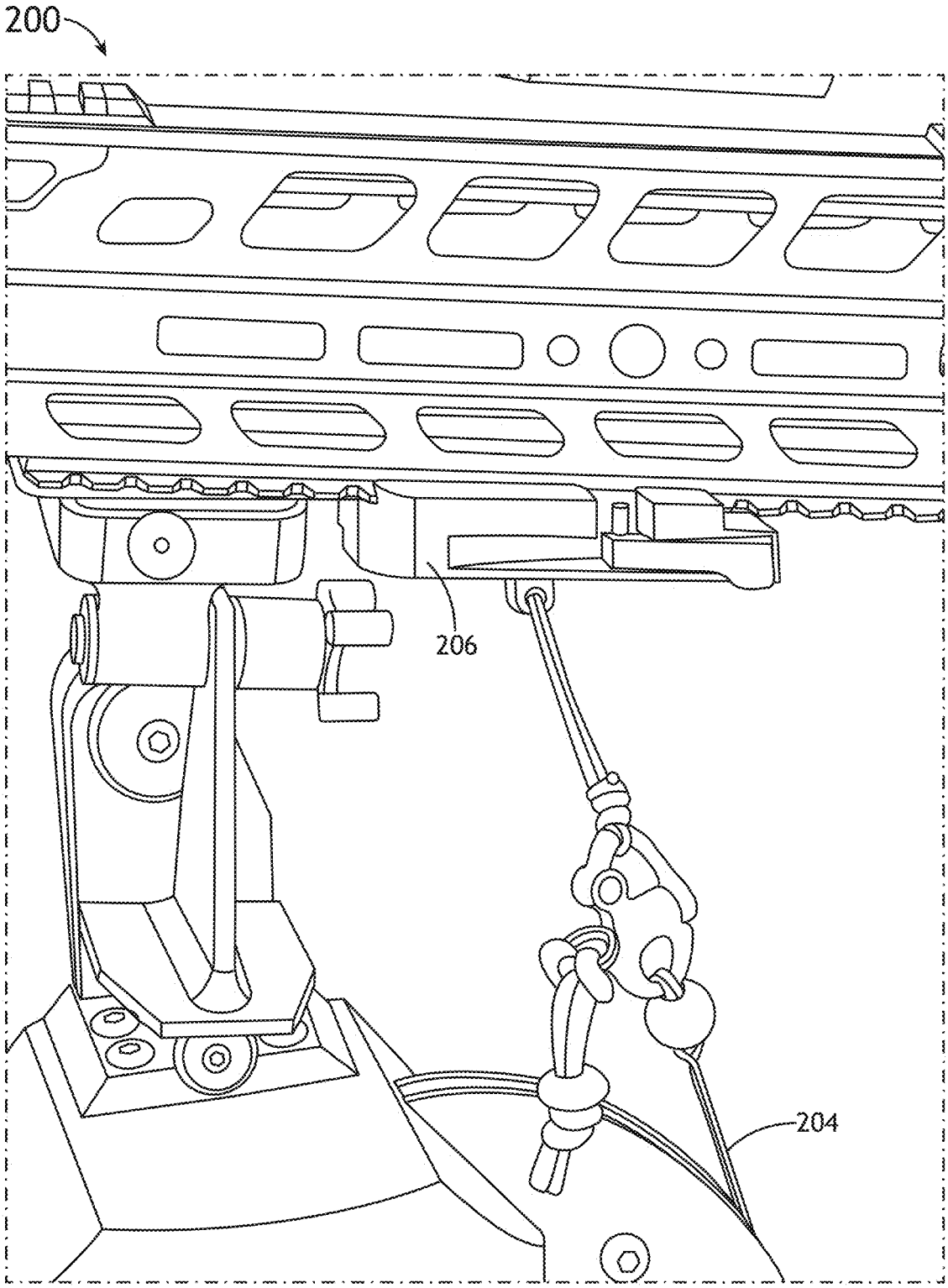
Figure 2D:
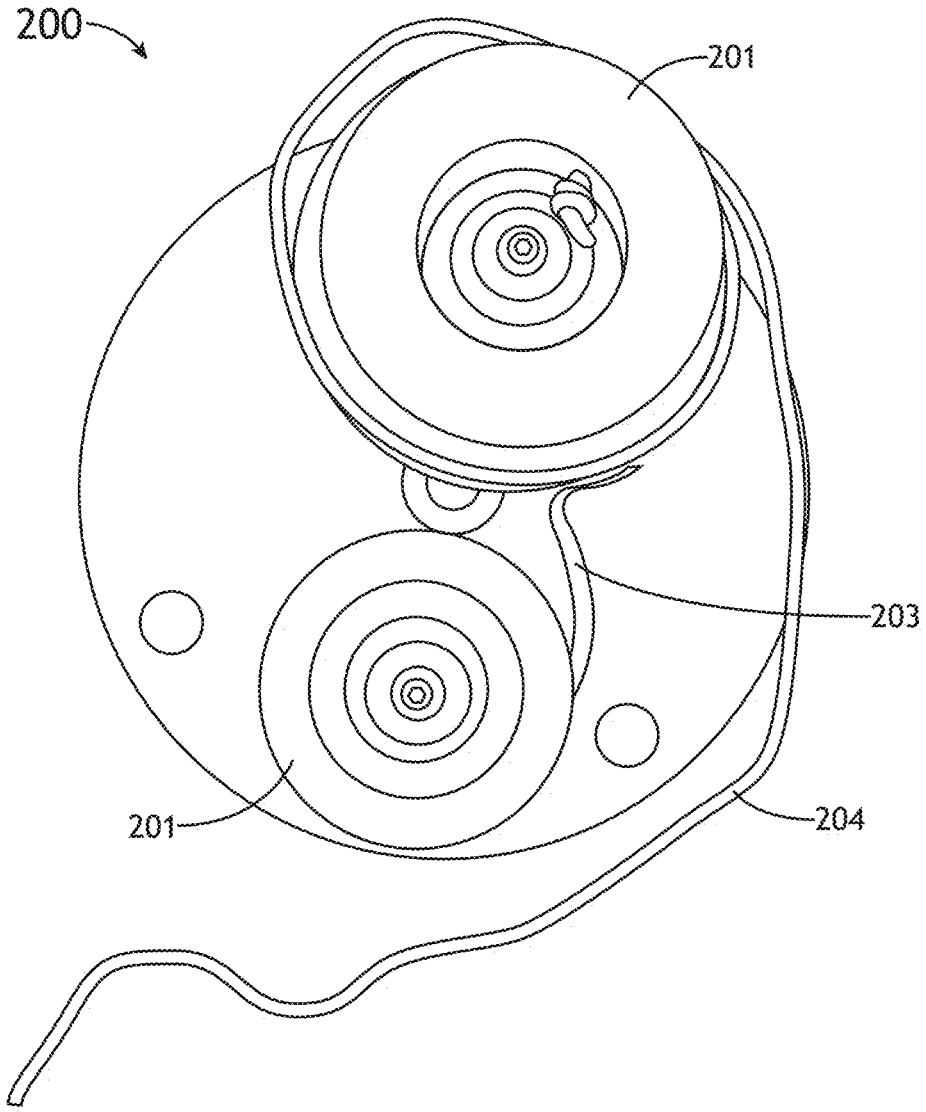
FIGS. 2D-2E illustrate perspective views of the one or more output drums and one or more springs of the tension control sub-system, in accordance with one or more embodiments of the present disclosure.
Figure 2E:
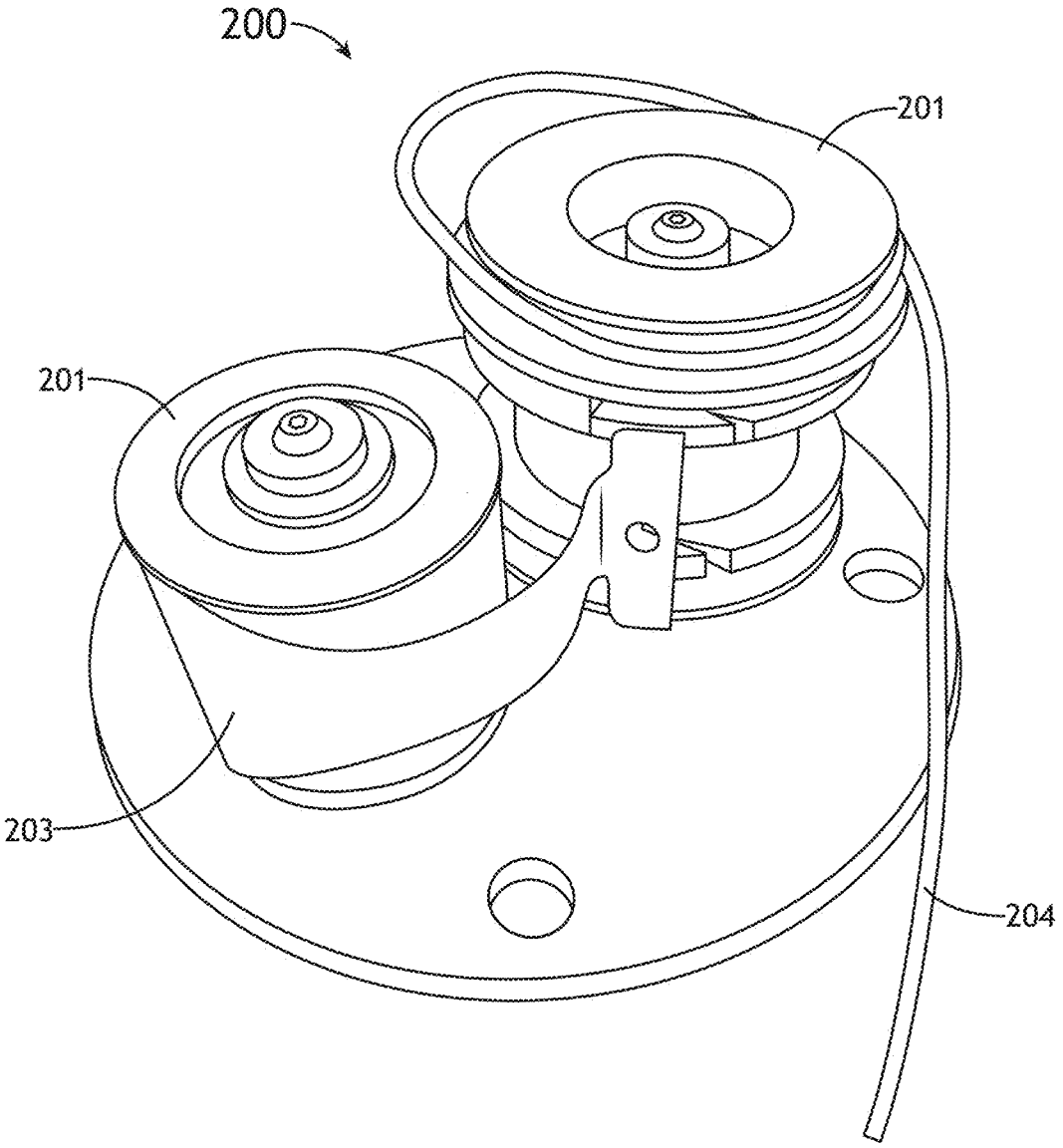
Figure 3A:
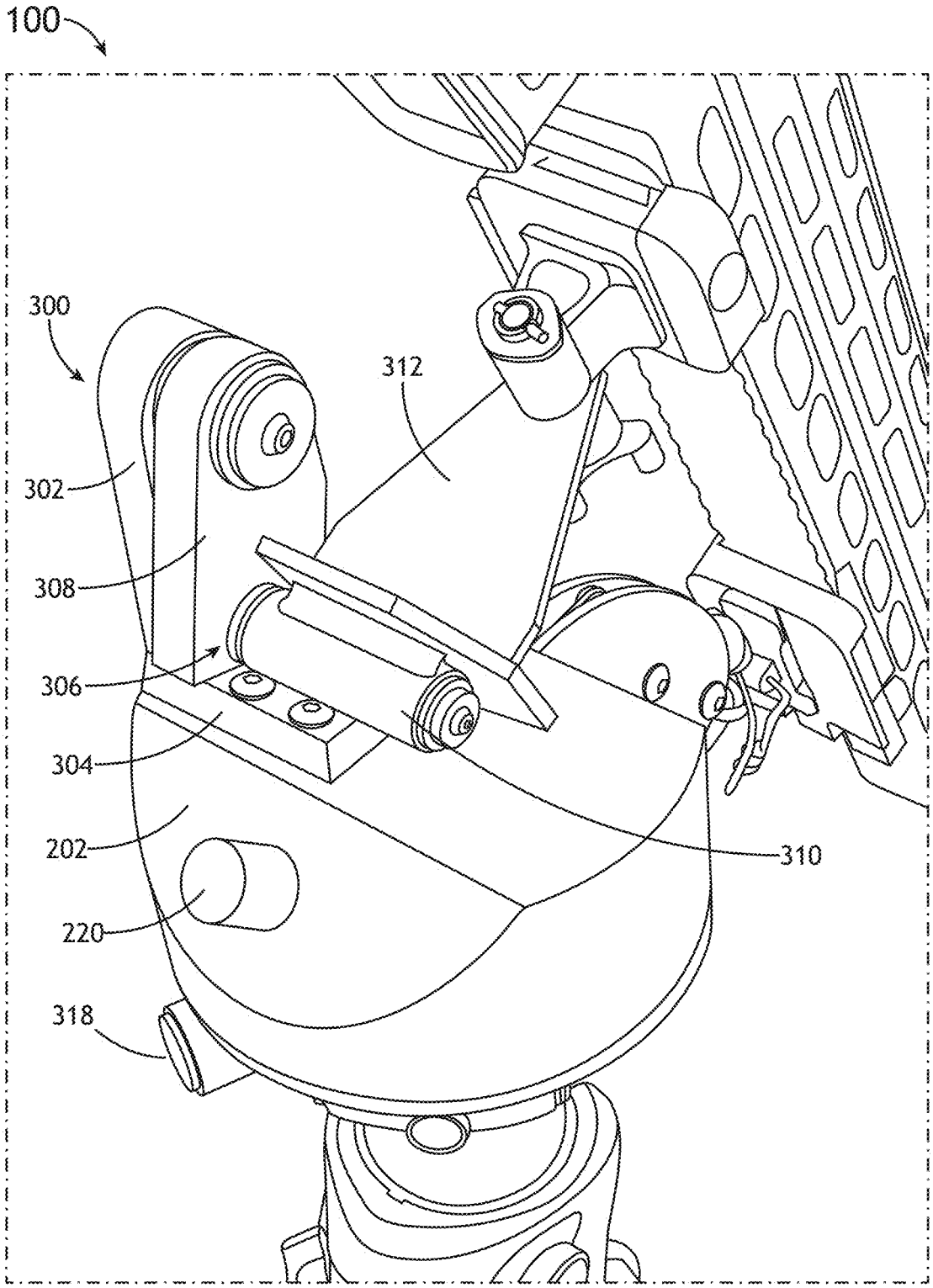
FIGS. 3A-3E illustrate perspective views of the firearm mounting system, in accordance with one or more embodiments of the present disclosure.
Figure 3B:
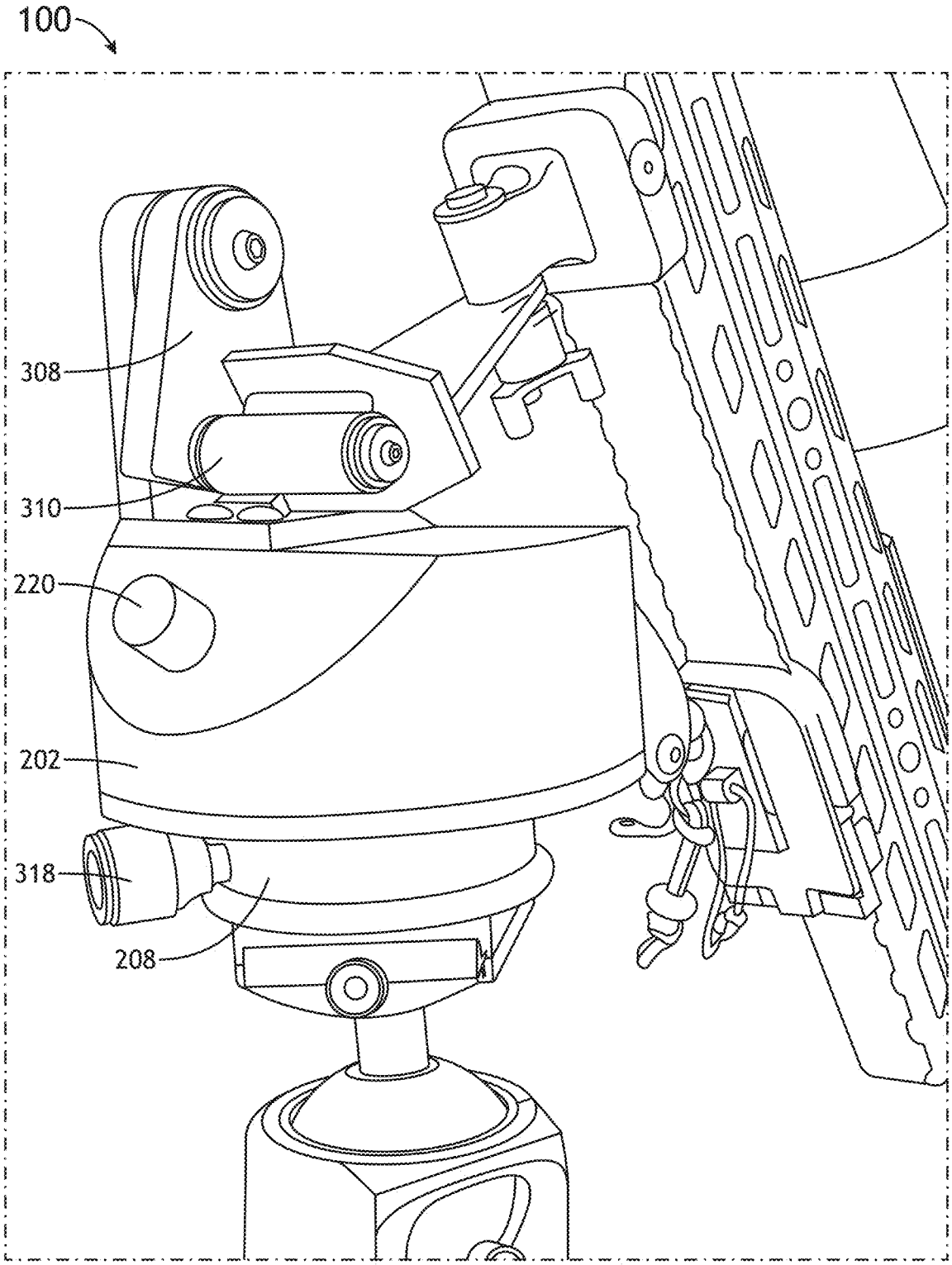
Figure 3C:
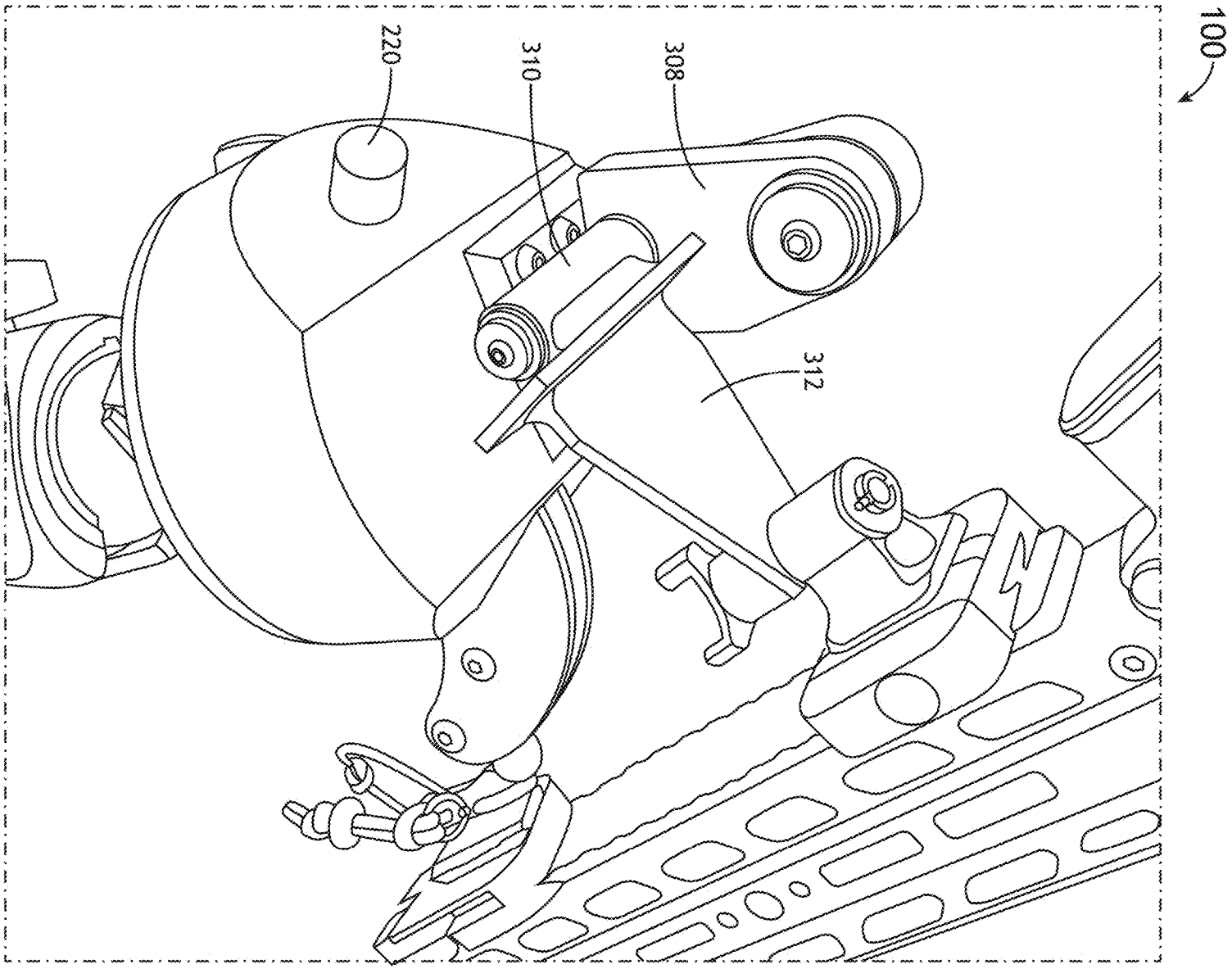
Figure 3D:
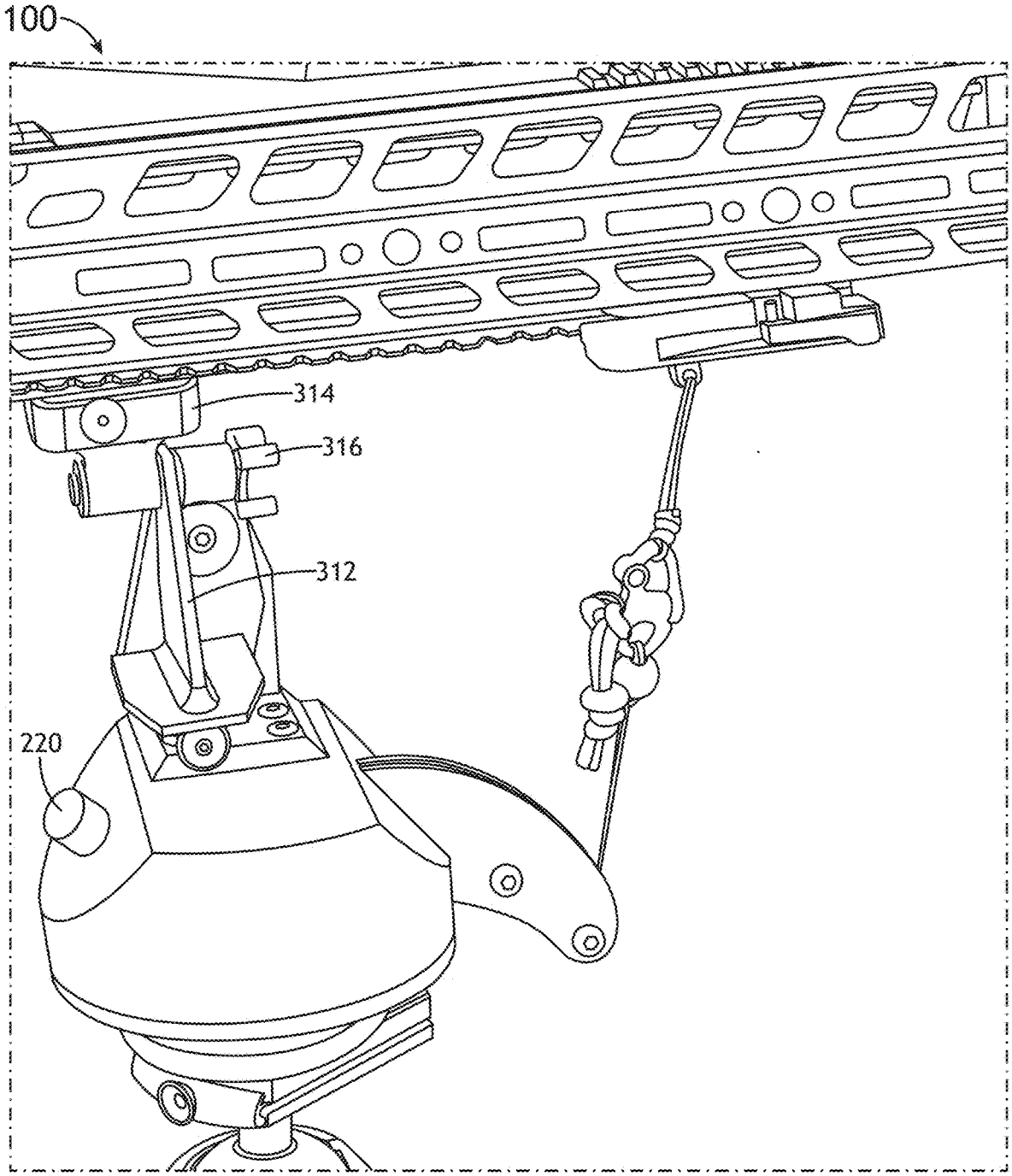
Figure 3E:
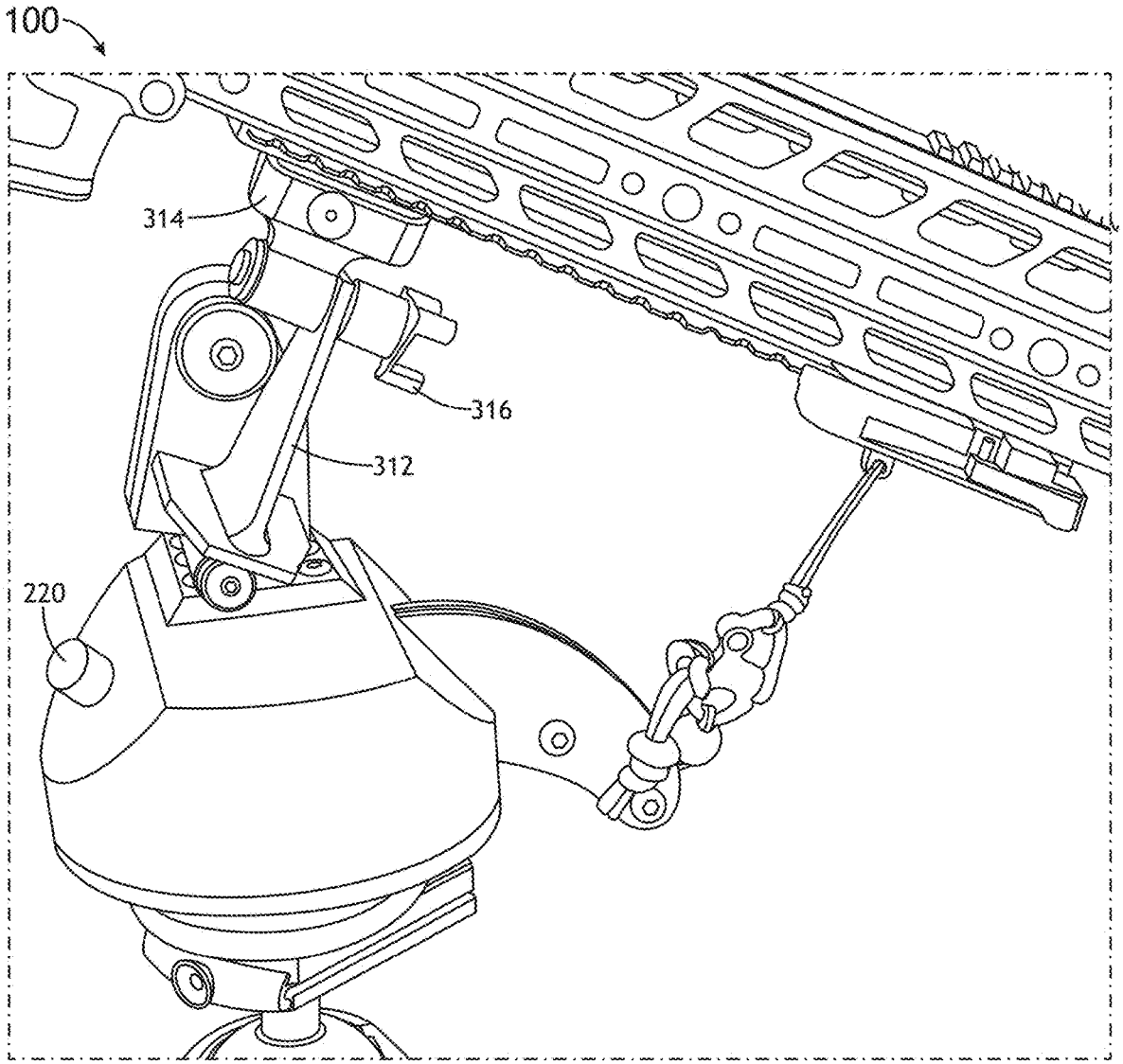
Figure 4A:
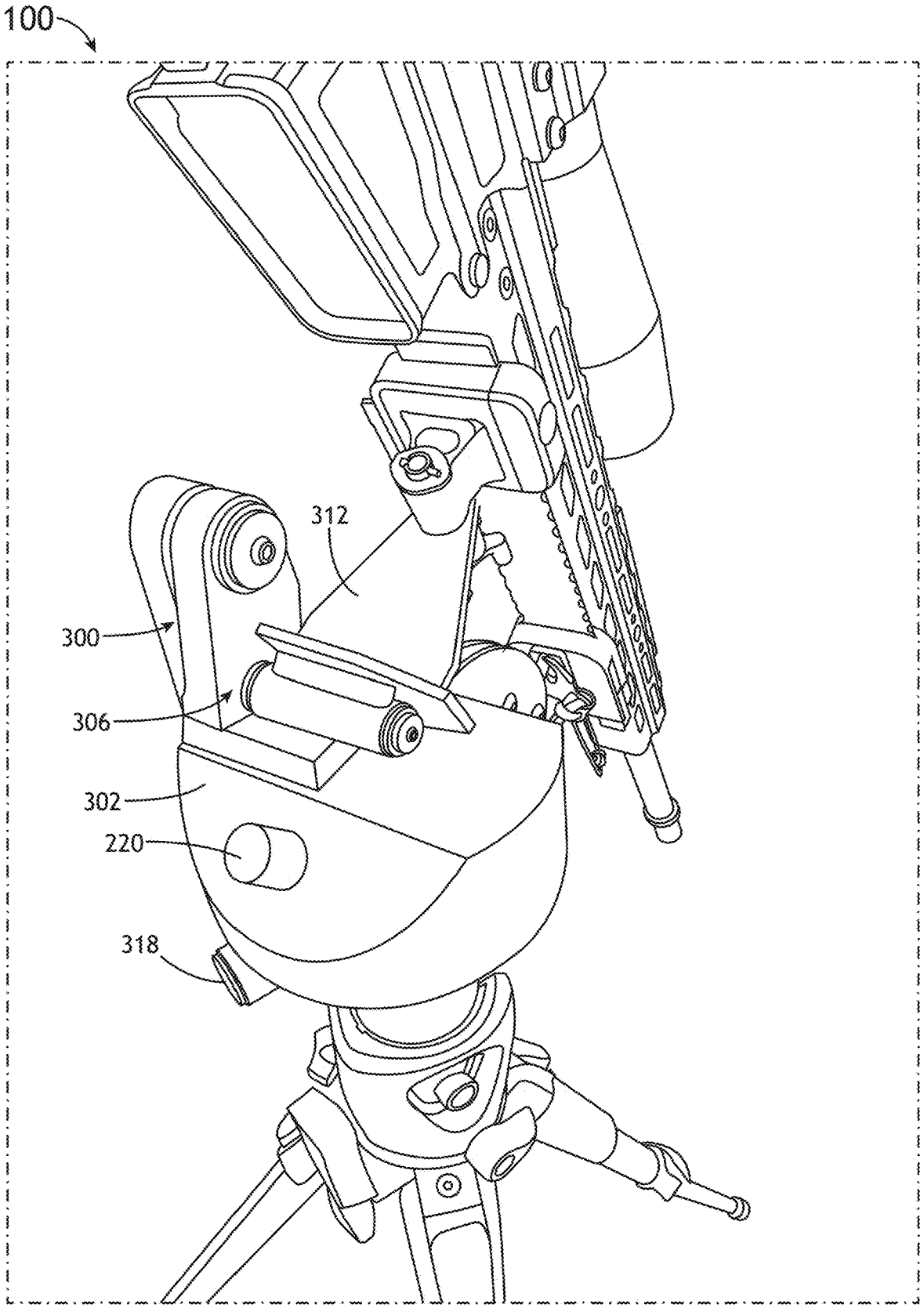
FIGS. 4A-4C illustrate perspective views of the firearm mounting system, in accordance with one or more embodiments of the present disclosure.
Figure 4B:
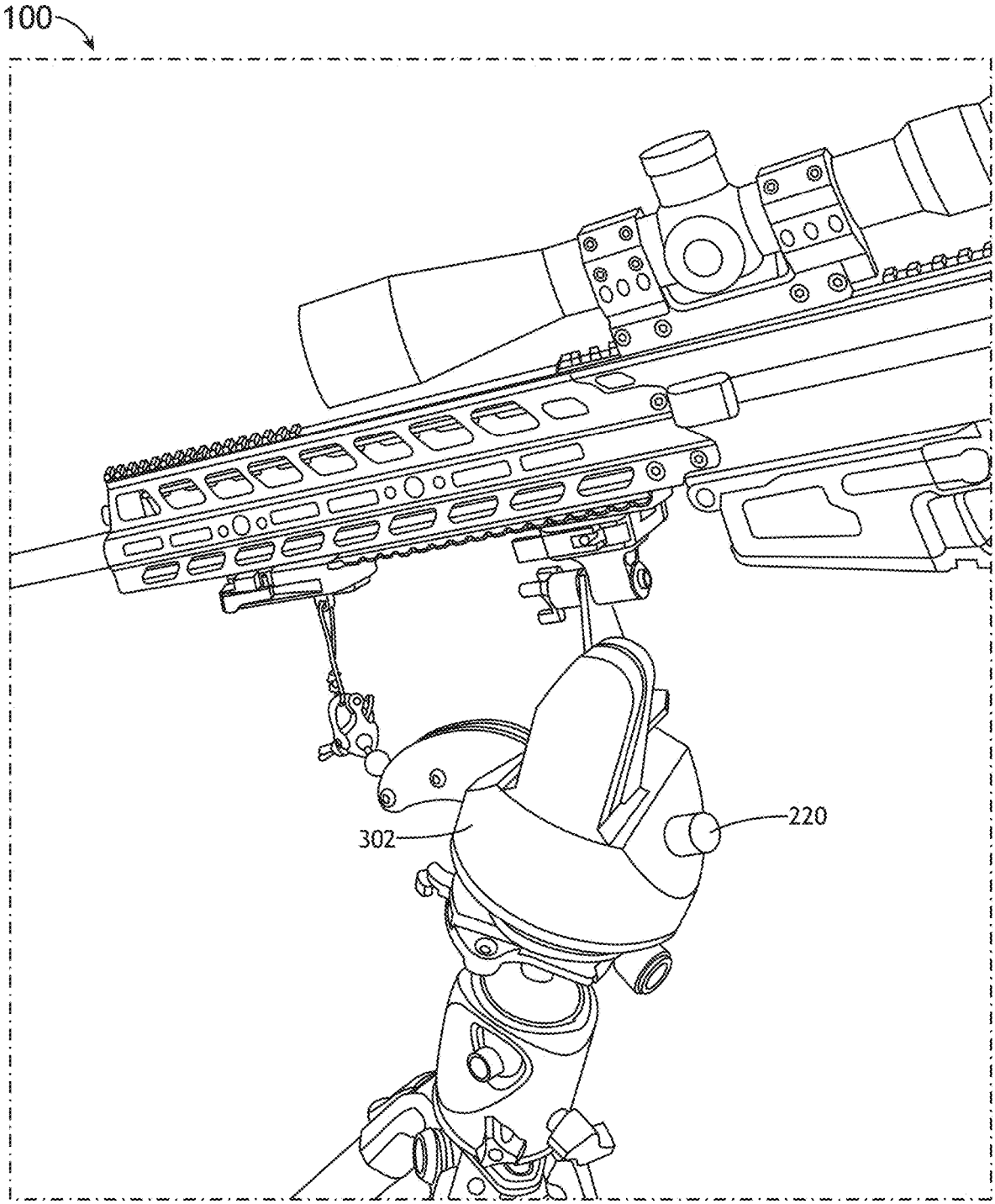
Figure 4C:
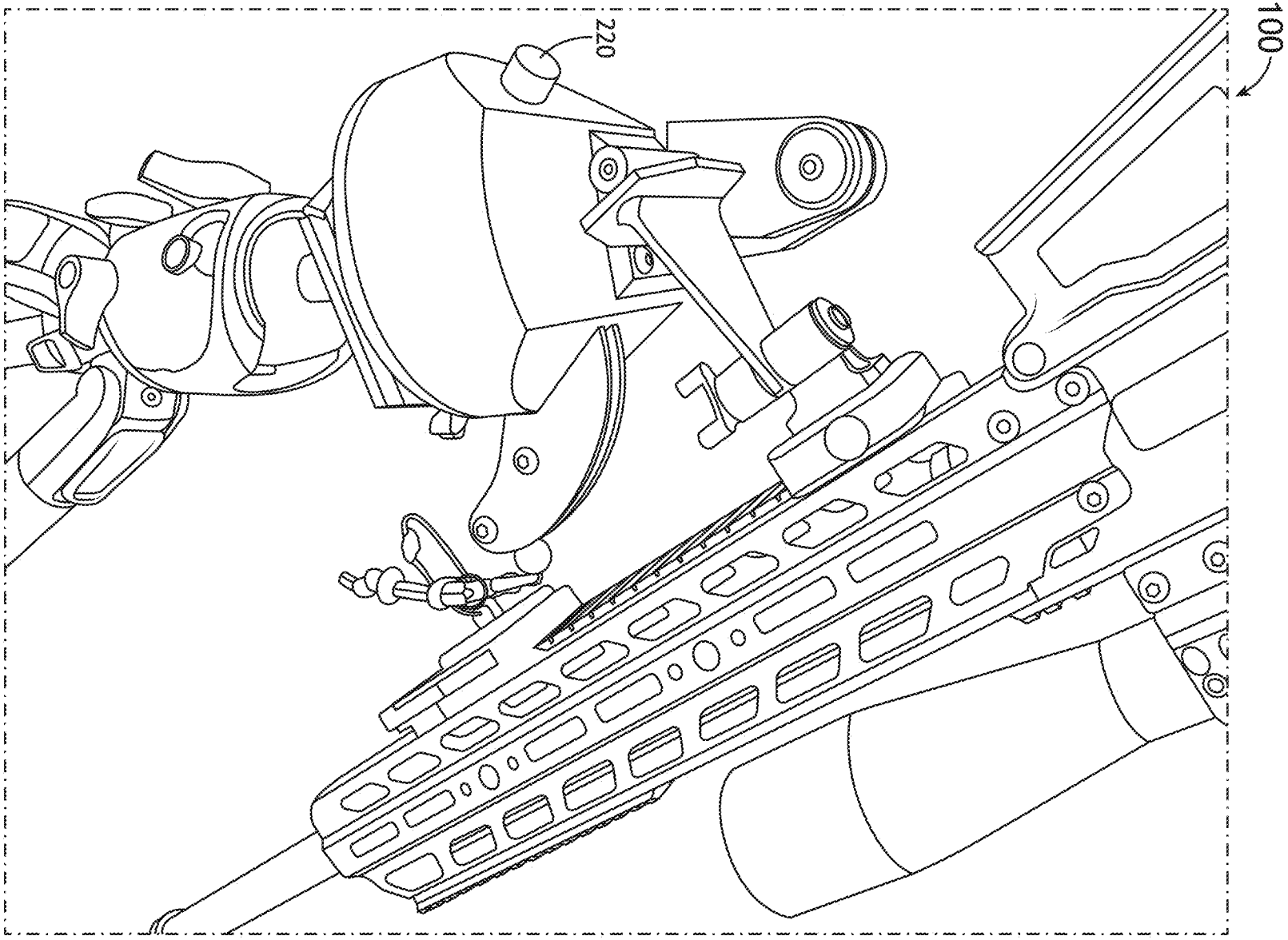

In embodiments, as shown in FIGS. 2D-2E, the tension control sub-system 200 includes one or more output drums 201 (e.g., reels) and one or more springs 203 (e.g., constant torque spring motors). For instance, these components may work together to maintain consistent tension on at least one line of flexible cable 204. It is noted herein that when the one or more output drums 201 are released and the flexible cable 204 is pulled, the one or more springs 203 may generate opposing torque, creating tension to help stabilize the firearm.

In embodiments, the tension control sub-system 200 further includes a braking mechanism configured to apply resistance to the at least one line of flexible cable 204. For instance, the braking mechanism may include a friction pad or disc that engages with at least one of the one or more output drums 201 or directly with the flexible cable 204.

The braking mechanism may be adjustable, enabling the user to vary the amount of resistance applied to the flexible cable 204. This adjustability may be achieved through a braking knob 220 or lever that increases or decreases the pressure of the friction pad against the one or more drums 201 or flexible cable 204. By adjusting the resistance, the user may fine-tune the tension to match specific operational needs such as, but not limited to, reducing cable movement during precision aiming or increasing tension for rapid repositioning.

The at least one line of flexible cable 204 may be directly attached to the firearm 102 by tying or securing it to a designated point, or it may be connected via a coupling device 206. For example, the coupling device 206 may use a carabiner clip or other attachment means to connect the flexible cable 204 to the firearm, allowing for easy attachment and detachment.

In embodiments, the tension control sub-system 200 further comprises a curved housing extension piece 218 attached to the base assembly 106. For example, the extension piece may be configured to direct the flexible cable 204 through a set of one or more pulleys, effectively guiding the flexible cable 204 away from the base assembly 106.

In embodiments, the curved housing extension piece serves multiple purposes. For instance, besides accommodating various firearm platforms, the length of the housing extension piece provides additional resistance, particularly beneficial for heavier firearm platforms. The longer the housing extension, the greater the resistance it offers. Both the length of the housing extension and the forward position of the coupling device on the rail may directly correlate to the resistance applied to the forward end of the firearm, affecting the experience of the shooter. The more forward and lateral the housing extension and coupling device are on the rail, the better they may absorb vertical recoil from the firearm. By way of another example, the curved housing extension piece may be detachable, allowing for eased customization and adjustment. Further, multiple custom lengths of the extension piece may be utilized to best accommodate various firearm platforms.

It is noted herein that the pulleys integrated into the curved housing extension piece may play a crucial role in facilitating smooth and controlled movement of the flexible cable 204. By guiding the flexible cable 204 through a predefined path, these pulleys ensure consistent tension is maintained, thereby preventing tangling or abrasion during operation. Moreover, positioning the coupling device further rearward and aligning it to be substantially parallel with the exit point of the flexible cable 204 from the extended housing helps in effectively mitigating felt recoil directed rearward, enhancing stability and control for the shooter during firearm operation.

In embodiments, the coupling device 206 is configured to slide along a rail attachment on the firearm 102. For instance, the rail may be configured to fix to a bottom surface of a handguard or stock of the firearm 102. A sliding mechanism may further allow a user to adjust the tension on the flexible cable 204 by moving the coupling device to different positions along the rail, as shown in FIGS. 2A through 2B.

In embodiments, the base assembly 106 includes a base body 202 configured to house various components of the tension control sub-system 200. For example, the one or more drums 201 and at least one line of flexible cable 204 may be at least partially enclosed within a cavity of the base body for protection and ease of use. By way of another example, the base assembly 106 may include an attachment plate coupled to a bottom surface of the base body 202. The attachment plate may be configured to directly couple to a support device such as, but not limited to, a monopod, bipod, tripod, or the like. In some embodiments, the support device may be configured to support a gimbal mechanism. The gimbal mechanism may be configured to provide movement of the firearm mounting system 100 on at least one of a vertical, horizontal, or rotational axis. Further, the base body 202 includes a panning base 208 positioned at the bottom portion of the base body. The panning base 208 facilitates smooth and fluid horizontal rotation of the base assembly 106 and the entire firearm mounting system 100, which allows the user to angularly pan the firearm about a central point on the panning base 208, providing enhanced maneuverability and target acquisition without having to reposition the entire support device.

In embodiments, the system 100 includes a control hub positioned between the gimbal mechanism and the base body 202. For instance, the control hub may include a panning control knob 318 configured to regulate the freedom of movement provided by the gimbal mechanism. Tightening the panning control knob 318 may restrict the movement of the system 100 along a single axis, while loosening the panning control knob 318 may allow for a fluid horizontal rotation of the base assembly 106 and the firearm mounting system 100. This enables smooth and precise horizontal movement, enhancing the ability of the user to track moving targets and adjust aim quickly.

In embodiments, the system 100 includes a bracket 300. For example, the bracket 300 may include, but is not limited to, an L-shaped bracket. The L-shaped bracket may be configured to attach to a top surface of the base body 202. Further, the bracket 300 may include a vertical support member 302 and a horizontal support member 304, offering additional stability and support.

In embodiments, the system 100 includes a swing arm 306, featuring a vertical support leg 308 and a horizontal support leg 310. The vertical support leg 308 may be pivotally coupled to the vertical support member 302 of the bracket 300, allowing the swing arm to pivot about an axis. The swing arm may be configured to manage recoil by distributing the force and reducing the impact on the user.

In embodiments, the horizontal support leg 310 is fixedly coupled to a support plate 312, which offers elevational control and further stability. The support plate 312 may be configured to attach to at least one support coupling 314, securing the firearm 102 in place.

Figure 5A:
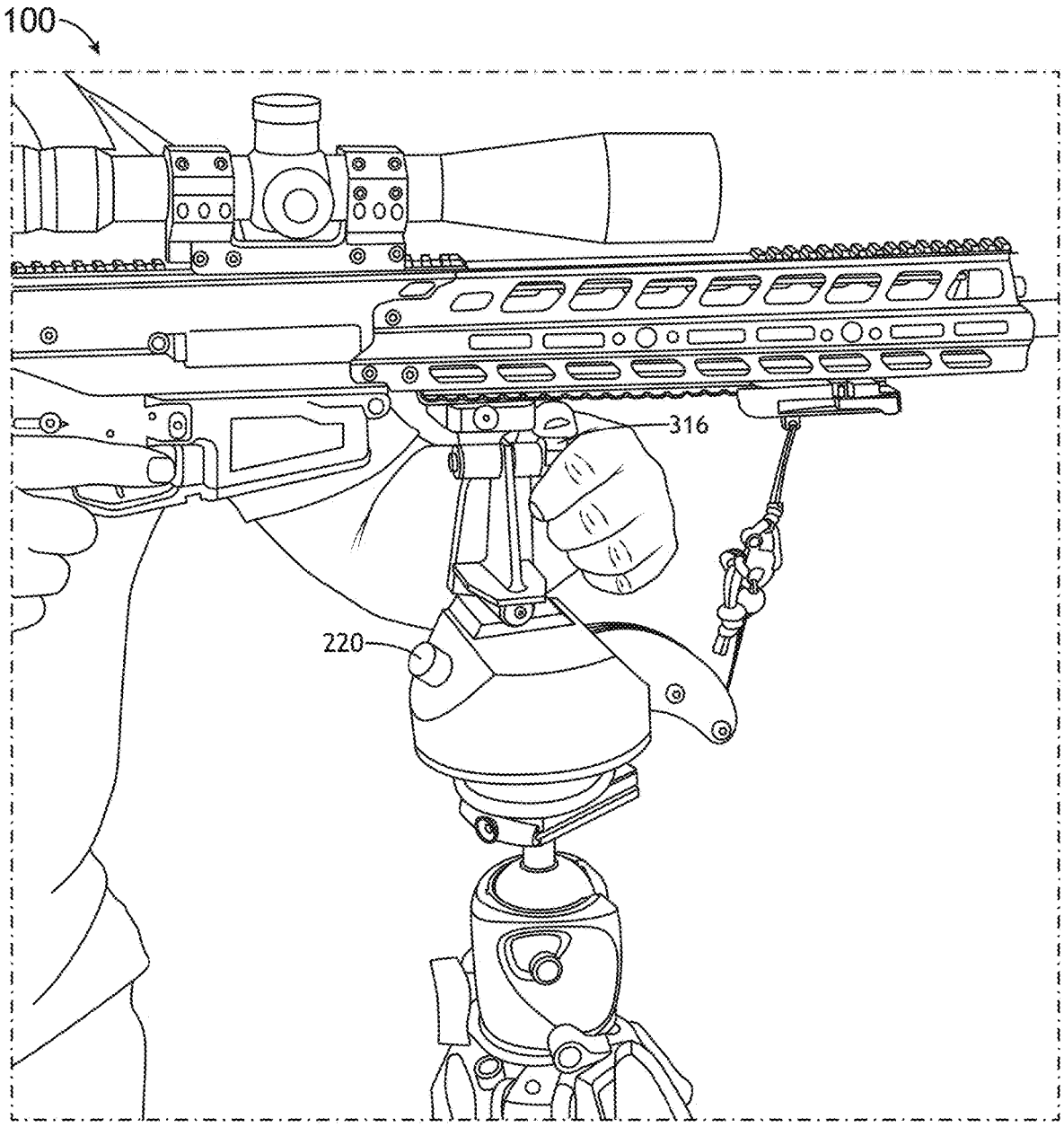
FIGS. 5A-5B illustrate perspective views of the firearm mounting system including adjustments for canting the firearm about an axis, in accordance with one or more embodiments of the present disclosure.
Figure 5B:
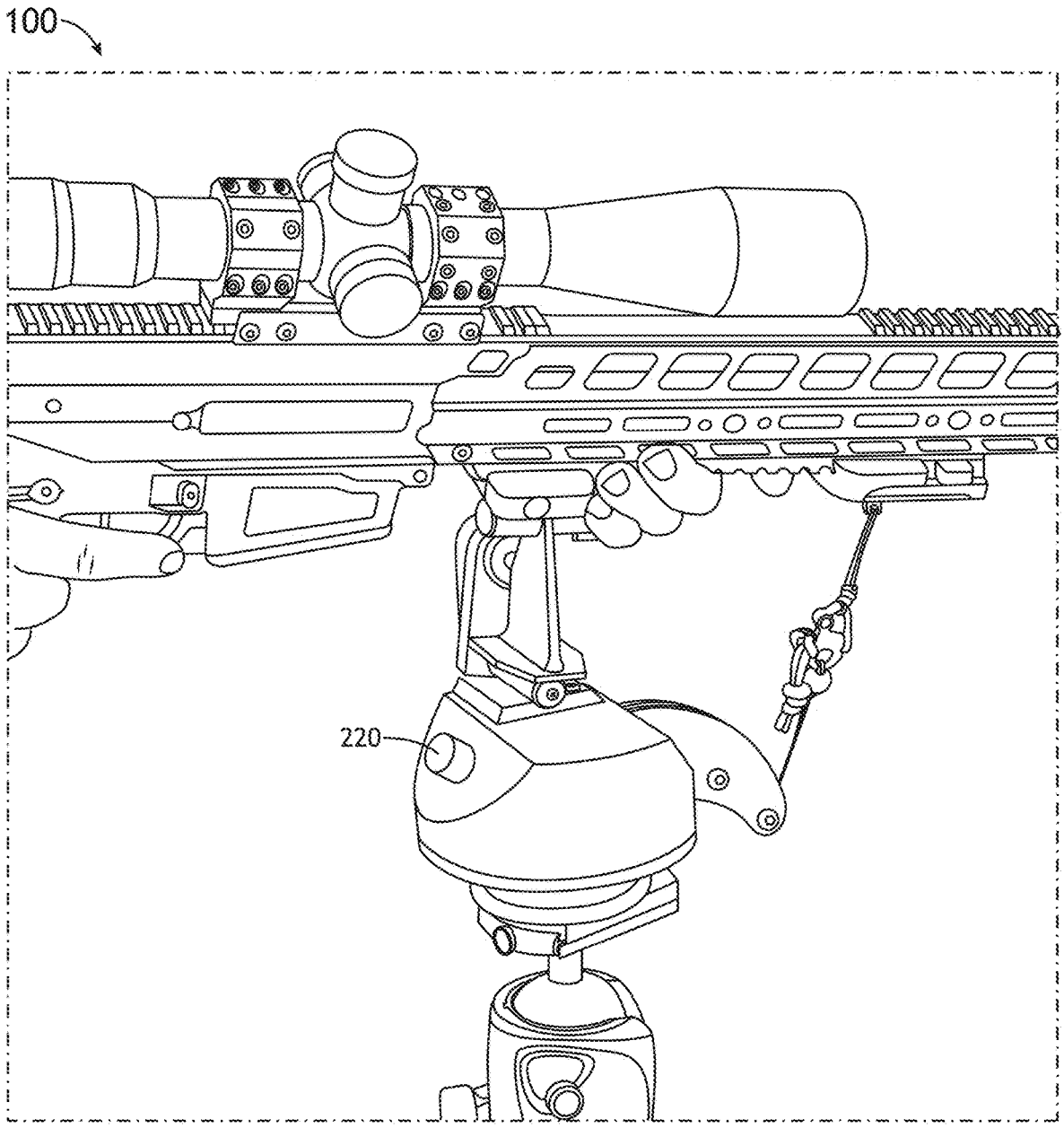

In embodiments, as shown in FIGS. 5A through 5B, the support plate 312 is pivotably coupled to a canting device 316. For instance, the canting device 316 includes a knob that may be loosened to allow the firearm 102 to cant or tilt about an axis (e.g., horizontal axis). This adjustment enables the user to cant or tilt the firearm left or right, facilitating the fast acquisition of targets on any plane. Additionally, this feature allows the user to level the firearm on uneven terrain, thereby maintaining accuracy. Tightening the knob secures the firearm in its current position, providing stable aiming and shooting for the user. It is noted herein that this capability enhances both the versatility and precision of the firearm mounting system in various shooting conditions.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken as limiting.

The previous description is presented to enable one of ordinary skill in the art to make and use the invention as provided in the context of a particular application and its requirements. As used herein, directional terms such as "top," "bottom," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A firearm mounting system, comprising:

a base assembly, the base assembly further comprising:

a base body; and a tension control sub-system;

a bracket coupled to a top surface of the base body;

a swing arm pivotably coupled to the bracket, wherein the swing arm further comprises a vertical support leg and a horizontal support leg configured to pivot about an axis;

a support plate coupled to the horizontal support leg of the swing arm, wherein the support plate is configured to provide elevational control of the firearm mounting system; and at least one support coupling configured to couple the support plate to at least a portion of a firearm.

2. The firearm mounting system of claim 1, wherein the tension control sub-system further comprises:

one or more output drums configured to hold at least one line of flexible cable; and one or more springs configured to provide a tension in response to the at least one line of flexible cable being pulled.

3. The firearm mounting system of claim 2, wherein the tension control sub-system further comprises a constant torque spring motor configured to provide a constant torque in an opposite direction when the at least one line of flexible cable is pulled away from the one or more output drums.

4. The firearm mounting system of claim 1, wherein the tension control sub-system further comprises a coupling device configured to slidably couple at one or more positions of a rail attachment located on a bottom surface of the firearm.

5. The firearm mounting system of claim 4, wherein the coupling device is configured to slide along the rail attachment fixed to a bottom surface of a handguard or stock of the firearm and attach at one or more positions along the rail attachment.

6. The firearm mounting system of claim 4, wherein the coupling device is configured to attach to the firearm via a carabiner clip.

7. The firearm mounting system of claim 4, wherein the coupling device is further configured to attach at least one line of flexible cable to the firearm.

8. The firearm mounting system of claim 1, further comprising:

a gimbal mechanism configured to provide movement of the firearm on at least one of a vertical, horizontal, or rotational axis.

9. The firearm mounting system of claim 8, wherein the gimbal mechanism is configured to provide movement of the firearm on a vertical axis.

10. The firearm mounting system of claim 8, wherein the gimbal mechanism is configured to provide movement of the firearm on a horizontal axis.

11. The firearm mounting system of claim 8, wherein the gimbal mechanism is configured to provide rotational movement of the firearm.

12. The firearm mounting system of claim 8, further comprising:

a control hub positioned between the gimbal mechanism and the base body, wherein the control hub is configured to control a freedom of movement provided by the gimbal mechanism.

13. The firearm mounting system of claim 12, wherein the control hub includes a control knob configured to loosen or tighten to respectively allow or constrain movement of the gimbal mechanism.

14. The firearm mounting system of claim 1, further comprising:

a canting device coupled to the support plate, the canting device including a knob configured to loosen or tighten to respectively allow the firearm to cant or tilt from one side to another and to secure the firearm in its current position.

15. The firearm mounting system of claim 1, wherein the swing arm is configured to manage an amount of recoil associated with a shooting of the firearm.

16. The firearm mounting system of claim 1, wherein the support plate is further configured to attach to the at least one support coupling.

17. The firearm mounting system of claim 16, wherein the at least one support coupling configured to attach to at least the portion of the firearm is configured to provide a further elevational control.

18. The firearm mounting system of claim 1, wherein the base assembly further comprises:

an attachment plate coupled to a bottom surface of the base body, wherein the attachment plate is configured to couple the base assembly to a support device including at least one of a monopod, bipod, or a tripod.

19. The firearm mounting system of claim 1, further comprising a control hub configured to limit a movement of the firearm mounting system to a single axis when tightened.

20. The firearm mounting system of claim 1, wherein the swing arm further comprises:

the vertical support leg configured to pivot about a vertical axis; and the horizontal support leg configured to pivot about a horizontal axis.

* * * * *